US011697784B2

(12) United States Patent
Davies

(10) Patent No.: US 11,697,784 B2
(45) Date of Patent: Jul. 11, 2023

(54) COMPOSITIONS AND METHODS FOR REDUCING FRICTION AT A SOLID:LIQUID INTERFACE

(71) Applicant: Global Barrier Services, Inc., San Clemente, CA (US)

(72) Inventor: Michael C. Davies, Dana Point, CA (US)

(73) Assignee: Global Barrier Services, Inc., San Clemente, CA (US)

( * ) Notice: Subject to any disclaimer, the term of this patent is extended or adjusted under 35 U.S.C. 154(b) by 0 days.

(21) Appl. No.: 17/257,831

(22) PCT Filed: Jul. 17, 2018

(86) PCT No.: PCT/US2018/042536

§ 371 (c)(1),
(2) Date: Jan. 4, 2021

(87) PCT Pub. No.: WO2020/018081

PCT Pub. Date: Jan. 23, 2020

(65) Prior Publication Data

US 2021/0292678 A1 Sep. 23, 2021

(51) Int. Cl.

| | |
|---|---|
| ***C10M 169/04*** | (2006.01) |
| ***C10M 101/04*** | (2006.01) |
| ***C10M 145/28*** | (2006.01) |
| ***C10N 30/00*** | (2006.01) |
| ***C10N 50/02*** | (2006.01) |

(52) U.S. Cl.

CPC ..... *C10M 169/041* (2013.01); *C10M 101/04* (2013.01); *C10M 145/28* (2013.01); *C10M 2207/401* (2013.01); *C10M 2209/104* (2013.01); *C10N 2030/62* (2020.05); *C10N 2050/02* (2013.01)

(58) Field of Classification Search

CPC ..... C10M 101/04; C10M 145/28; C10M 169/041; C10M 2207/401; C10M 2209/104; C10N 2030/62; C10N 2050/02

See application file for complete search history.

(56) References Cited

U.S. PATENT DOCUMENTS

| | | | | |
|---|---|---|---|---|
| 5,122,288 | A * | 6/1992 | Shiraishi | C10M 149/04 508/497 |
| 5,998,340 | A * | 12/1999 | Furutani | C07C 69/34 428/65.8 |
| 6,811,810 | B2 * | 11/2004 | LaFay | B28B 7/384 427/133 |
| 2003/0181340 | A1 * | 9/2003 | Botz | C10M 169/04 508/451 |
| 2010/0016180 | A1 | 1/2010 | Scoggins | |
| 2012/0101016 | A1 * | 4/2012 | Hosoda | C10M 169/04 508/306 |
| 2014/0020658 | A1 | 7/2014 | Noles, Jr. | |
| 2017/0223904 | A1 * | 8/2017 | Raccanello | A01G 7/045 |

FOREIGN PATENT DOCUMENTS

| | | | |
|---|---|---|---|
| WO | 03020855 | 3/2003 | |
| WO | 03068897 | 8/2003 | |
| WO | WO-03068897 A1 * | 8/2003 | C10M 169/04 |
| WO | 2017176244 | 10/2017 | |

* cited by examiner

*Primary Examiner* — James C Goloboy

(74) *Attorney, Agent, or Firm* — Fish IP Law, LLP

(57) ABSTRACT

Compositions and methods are provided that generated a persistent low-friction coating on a solid surface, by application of a mixture of a polyethylene glycol-containing surfactant and a vegetable to the surface. The coating thus generated does not require replenishing during use and persists through rinsing and multiple uses. Surprisingly, markedly reduced friction is found when the surfactant is provided at 3% w/v to 7% w/v in the composition. Such compositions and methods are suitable for application to both mixing and separation operations. Formulation of such compositions with food grade components permits use in food processing.

13 Claims, No Drawings

COMPOSITIONS AND METHODS FOR REDUCING FRICTION AT A SOLID:LIQUID INTERFACE

FIELD OF THE INVENTION

The field of the invention is fluid handling, particularly mixing and separation operations.

BACKGROUND

The following description includes information that may be useful in understanding the present invention. It is not an admission that any of the information provided herein is prior art or relevant to the presently claimed invention, or that any publication specifically or implicitly referenced is prior art.

Liquid handling operations that involve mixing of solid and liquid components or separation of solids from liquid suspensions are common, but notably energy-intensive, operations. For example, mixing of cement and aggregate with water to produce concrete is frequently performed by adding these components to large, rotating drums. These very dense mixtures tend to adhere to the interior of such mixing drums, and require considerable energy expenditure to rotate at speeds sufficient to provide adequate mixing. Similarly, wastewater frequently presents with considerable organic solids content that needs to be removed for adequate treatment of the liquid portion. This can be achieved through the use of centrifugal separators that provide essentially continuous separation and removal of solids from wastewater streams, however considerable energy is expended in both removal of organic solids and in maintenance and cleaning of the surfaces against which these sticky organic solids collect.

Attempts have been made to improve efficiency or reduce energy consumption in such operations by reducing friction or solids buildup on the working surfaces of such devices. For example, U.S. Pat. No. 9,863,296, to Pogen, describes a device that provides a continuous flow of oil over working surfaces of a centrifugal separator while the device is in operation. All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply. The oil coating so provided serves to prevent solids from adhering to the working surfaces. Such an approach, however, is mechanically complex, and also necessarily introduces oil contamination into the liquid portion of the suspension being separated.

German Patent Application No. DE224613, to Ruschke and Agular, describes a devices and methods for reducing sludge buildup on separating surfaces of a centrifugal separator, by applying a 'peeling device' to physically remove solids from the separator drum during operation. While this avoids contamination issues, the approach is mechanically complex and not generally applicable to all fluid/solid handling processes.

Thus, there is still a need for compositions and methods that can reduce energy consumption by reducing friction at working surfaces used in fluid handling operations.

SUMMARY OF THE INVENTION

The inventive subject matter provides compositions and methods that reduce friction on working surfaces, particularly solid/liquid interfaces. Compositions that include a vegetable oil and a polyethylene glycol-containing nonionic surfactant are applied to a working surface to generate a persistent reduced friction coating (i.e. one which does not need to be continuously applied to retain its reduced friction property). In embodiments of the inventive concept such a persistent reduced friction coating can retain reduced friction characteristics following removal of a coating composition, and in some embodiments can retain reduced friction characteristics throughout use following application and removal of a coating composition. For example, reduced friction characteristics of a surface so treated can be retained through 2, 2, 3, 4, 5, 6, 7, 8, 9, 10, or more than 10 cycles of use in non-continuous operations. Similarly, reduced friction characteristics of a surface so treated can be retained through at least 30 minutes, 1 hour, 2 hours, 3 hours, 4 hours, 5 hours, 6 hours, 8 hours, 10 hours, 12 hours, 16 hours, 24 hours, or more than 24 hours of continuous operation following application of a coating composition. Surprisingly, the Inventors have identified a limited range of surfactant concentrations (3% to 7% w/v) in vegetable oil that provide a dramatic reduction (e.g. from 80% to 90%) in friction when compared to corresponding compositions where the surfactant concentration is less than 3% w/v or more than 7% w/v. Suitable working surfaces include those employed in mixers and centrifugal separators.

One embodiment of the inventive concept is a coating composition for reducing friction at a solid:fluid interface, which includes a vegetable oil and a surfactant that includes polyethylene glycol. The surfactant is present at from 3% w/v to 7% w/v, and the coating composition provides a reduced friction surface when applied to a solid surface. Such a reduced friction surface can show an 80% or greater reduction in friction relative to a similarly treated surface generated by contact with a corresponding coating composition in which the surfactant is present at less than 3% w/v or greater than 7% w/v. Vegetable oils suitable for this purpose include almond oil, beech nut oil, brazil nut oil, cashew oil, coconut oil, corn oil, cottonseed oil, grapefruit seed oil, hazelnut oil, lemon oil, macadamia nut oil, mongogo nut oil, olive oil, orange oil, palm oil, peanut oil, pecan oil, pine nut oil, pistachio nut oil, pumpkin seed oil, rapeseed/canola oil, safflower oil, sesame oil, soybean oil, sunflower oil, and walnut oil. Such a vegetable oil can be provided without degumming, for example a non-degummed soybean oil. In some such embodiments the surfactant that includes polyethylene glycol is a food-grade surfactant. Suitable surfactants for producing such a composition include a surfactant containing polyethylene glycol, a surfactant containing a polyethylene glycol/polypropylene glycol copolymer, a surfactant containing a polyethylene glycol ether, a surfactant containing a polyethylene glycol/polypropylene glycol copolymer ether, a surfactant containing an alkylated polyethylene glycol ether, a surfactant containing a polyethylene glycol/polypropylene glycol copolymer ether, a surfactant containing an ethoxylate of an alkylated polyethylene glycol ether, and a surfactant containing an ethoxylate of a polyethylene glycol/polypropylene glycol copolymer ether.

Another embodiment of the inventive concept is a method of reducing energy consumption in a solid:liquid handling operation, by applying a composition as described above to a working surface for a period of time sufficient to generate a reduced friction layer on the working surface. In some embodiments the method includes the additional step of rinsing the working surface after the reduced friction layer is formed and prior to adding materials to be mixed. Such a method can be applied to a centrifugal separation, such as a centrifugal separation performed as part of a water or waste treatment process or a food processing operation. Such a method can also be applied to mixing operations that suspend a particulate solid in a liquid, for example during a construction operation and/or concrete mixing.

Another embodiment of the inventive concept is a method of generating a low friction solid:liquid interface, by applying a composition as described above solid for a period of time sufficient to generate the low friction solid:liquid interface. In some embodiments the method can include the additional step of removing excess composition from the solid prior to use, for example by rinsing or washing the solid with a fluid that does not include the composition. Such a method can be applied to a solid that is a mixing surface, such as a mixing surface designed to suspend a particulate solid in a liquid. Such a method can also be applied to a separating surface, such a surface of a centrifugal separator.

Various objects, features, aspects and advantages of the inventive subject matter will become more apparent from the following detailed description of preferred embodiments, along with the accompanying drawing figures in which like numerals represent like components.

DETAILED DESCRIPTION

Compositions and methods are provided that generate a layer on a solid surface, such as a working surface in a liquid/solids handling operation, that reduces friction and/or adhesion at the surface:liquid interface. Such compositions include a vegetable oil (such as a soybean oil) and a surfactant, and can be supplied as a mixture that is applied directly to the solid working surface. The low or reduced friction coating so generated is persistent and does not need to be reapplied during or between repeated operations. In some embodiments excess composition can be removed (for example by rinsing or washing with a liquid that does not include the composition), with a low friction layer being retained on the solid working surface. Surprisingly, Inventors have found that the friction generated at such a surface is dramatically reduced over a limited range of surfactant concentrations. Additionally, significant energy saving are realized when working surfaces so treated are employed in various industrial-scale process (such as concrete mixing, separation of solids from waste water, etc.).

One should appreciate that compositions and methods of the inventive concept provide a reduction in friction and/or adhesion leads to both a reduction in energy consumption and simplification of maintenance in common solid/liquid handling operations. Advantageously, compositions and methods of the inventive concept can be applied to existing equipment without the need for modification or adaptation of the equipment.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value with a range is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

One embodiment of the inventive concept is a composition that includes a vegetable oil and a surfactant, and that provides a persistent (e.g. for at least 12 hours) low or reduced friction coating when applied to a working solid surface. Such a persistent coating is retained through multiple or continuous use of the coated solid surface in liquid: solid handling processes (e.g. mixing, separation) without a need to re-apply or continuously apply the composition. Suitable vegetable oils include almond oil, beech nut oil, brazil nut oil, cashew oil, coconut oil, corn oil, cottonseed oil, grapefruit seed oil, hazelnut oil, lemon oil, macadamia nut oil, mongogo nut oil, olive oil, orange oil, palm oil, peanut oil, pecan oil, pine nut oil, pistachio nut oil, pumpkin seed oil, rapeseed/canola oil, safflower oil, sesame oil, soybean oil, sunflower oil, and/or walnut oil. Such oils can be refined (e.g. degummed) or unrefined (e.g. non-degummed). In some embodiments a single oil species is used. In other embodiments two or more oils can be blended prior to use as an oil component in the composition. In some embodiments the oil or oils utilized are food-grade oils, suitable for use in food handling and processing. In a preferred embodiment the vegetable oil is a non-degummed soybean oil; such non-degummed soybean oils typically have an elevated fatty acid content relative to more highly processed, degummed soybean oils.

Suitable surfactants include, but are not limited to, non-ionic surfactants. Suitable surfactants include derivatives of polyethylene glycol and/or polyethylene glycol/polypropylene glycol copolymers, including polyethylene glycol and/or polyethylene glycol/polypropylene glycol copolymer ethers, alkylated polyethylene glycol and/or polyethylene glycol/polypropylene glycol copolymer ethers, and ethoxylates of alkylated polyethylene glycol and/or polyethylene glycol/polypropylene glycol copolymer ethers. Examples of suitable surfactants include members of the Lutensol® family of surfactants, including Lutensol® A 12 N, Lutensol® A 3 N, Lutensol® A 9 N, Lutensol® AO 3, Lutensol® AO 8, Lutensol® LA 60, Lutensol® OP 10, Lutensol® 40 70%, Lutensol® TDA 10, Lutensol® TDA 3, Lutensol® TDA 6, Lutensol® TDA 8 90%, Lutensol® TDA 9, Lutensol® XL 100, Lutensol® XL 140, Lutensol® XL 70, Lutensol® XL 79, Lutensol® XL 80, Lutensol® XL 90, Lutensol® XP 30, Lutensol® XP 40, Lutensol® XP 50, Lutensol® XP 70, Lutensol® XP 79, Lutensol® XP 80, Lutensol® XP 89, and Lutensol® XP 90 and their structural equivalents. In some embodiments a single surfactant species is utilized in the composition. In other embodiments two or more surfactants can be utilized as the surfactant component of such a composition.

Surprisingly, Inventors have found that when surfactant content of the composition is from about 3% w/v to about 7% w/v, the low or reduced friction coating generated by application of the application to a working surface (e.g. a mixing surface or blade, a collecting surface, etc.) provides a greater reduction in friction and/or improved persistence over similar compositions containing less than about 3% w/v or more than about 7% w/v surfactant. Typically and 80% to 90% reduction in friction is observed at surfaces treated with a coating composition that includes a vegetable oil and a surfactant as described above in a concentration range of from about 3% to about 7% w/v, relative to such a surface treated with a coating composition that includes less than about 3% w/v or greater than about 7% w/v of surfactant.

To generate the desired low or reduced friction coating a composition as described above is applied to a working surface, such as a plastic, ceramic, glass, metal, and/or composite surface utilized in a fluid/solid handling process. The composition can be applied by any suitable means, and can vary depending upon the nature of the equipment to which it is being applied. For example, the composition can be effectively applied to the interior of a mixing drum (e.g. for concrete mixing) by spraying. Alternatively, the composition can be effectively applied to a more sealed system (e.g. the interior surfaces of a centrifugal separator) by applying a volume of the composition that flows over and/or through portions of a device where the working surface is exposed. The composition can be left in place for a period of time sufficient for the low or reduced friction coating to form. This process can be essentially instantaneous, relying on noncovalent interactions between elements of the composition and the working surface that occur immediately upon contact. In other embodiments a contact time ranging from 10 mseconds to 12 hours can be provided between a composition of the inventive concept and the working surface.

In some embodiments a low or reduced friction coating can be applied to a portion of a mixing or separating device, for example a mixing blade, mixing drum interior, and/or centrifuge container. Such portions can be coated as part of an assembled device (for example, by localized application of a composition of the inventive concept) or can be coated as separated portions and then added to or installed on a device. Alternatively, a low or reduced friction coating can be produced by introducing a composition of the inventive concept to a fluid inlet of an assembled mixing or separation device and allowing it to flow through all or part of the device. Inventors contemplate that such system-wide application can provide additional energy and/or fuel savings during operation by reducing friction at relatively inactive portions surfaces of such systems, such as interior walls of pipes and tubing used for fluid transfer, etc.

The low or reduced friction coating generated by such process and using such compositions is, surprisingly, persistent (i.e. remains effective during or through use without replenishment). As such the composition does not need to be applied prior to each use (e.g. of devices engaged in batch operations) and/or during use (e.g. of devices that are in continuous operation). This is particularly surprising in light of the noncovalent nature of the interaction between coating species and the working surface and the generally harsh nature of liquid:solid handling process, which are typically vigorous. Such a low or reduced friction coating generated as described above utilizing a composition of the inventive process can persist (i.e. remain effective without replenishment) through at least 4, 6, 8, 12, 18, 24, 36, 48, or more than 48 hours of continuous and/or periodic (i.e. repeated) use. Similarly, a low or reduced friction coating of the inventive process can persist through 2, 3, 4, 5, 6, 7, 8, 9, 10, 12, 14, 16, 18, 20, 25, 30, 35, 40, 45, 50, 60, 70, 80, 90, 100, or more than 100 cycles of operation in non-continuous processes.

It should be appreciated that the persistent nature of the low or reduced friction coating so generated permits a rinsing or washing step to be added to some coating operations in order to remove excess coating composition. For example, following application of a composition of the inventive process to a surface to produce a low or reduced friction coating, excess coating composition can be removed prior to use. In some embodiments a rinse or wash step, in which a liquid that does include one or more components of a composition of the inventive process is applied, can be performed following formation of the low or reduced friction surface. In some embodiments such a rinse or wash liquid can have a composition that corresponds to at least a portion of the liquid component of a liquid/solid mixture to be mixed or separated. For example, when used to provide a low or reduced friction surface in a centrifugal separator intended for separation of dairy products, the interior of such a centrifugal separator can be rinsed with water following application of a composition of the inventive concept. This can be desirable in processes in which the presence of elements of a coating composition are to be minimized or eliminated in a product of the process, such as those in which foodstuffs are handled.

The above described compositions and methods are applicable to wide range of liquid:solid handling operations, in particular mixing or suspension of solids (e.g. particulate solids) in liquids. Such operations typically take place within a drum or similar structure that encloses the liquid and the solids, with the drum being rotated in order to provide a mixing action. Such a drum can include structures on the interior surface (e.g. blades, etc.) that serve to improve agitation and mixing. The interior of such a drum and attendant structures constitute working surfaces in such a mixing operation. An example of such an operation is the mixing of cement and aggregate solids with water to form concrete. In such operations it is typical for such mixtures to adhere to the wall of the mixing drum as it rotates, resulting in significant energy expenditures as rotation of the drum necessitates lifting of the heavy adhering layer. Surprisingly, Inventors have found that application of a composition as described above to the interior of such a mixing drum can significantly reduce energy expenditure in such mixing operations without compromising mixing action. The Inventors believe that more effective (e.g. earlier) release of the layer of liquid/solid mixture adhering to working surfaces of the drum during rotation reduces energy requirements for rotation of the drum. Energy savings of from 5%, 10%, 15%, 20%, 25%, or more than 25% relative to corresponding operations performed without the application of a coating composition of the inventive concept prior to mixing have been realized. Surprisingly, such energy savings are observed to increase dramatically (e.g. a reduction of 20% or more in energy expenditure relative to an otherwise identical process performed using an untreated surface) when the surfactant content of the coating composition is between 3% w/v and 7% w/v. It should be appreciated that energy expenditure can be observed directly or indirectly (e.g. reduced fuel consumption of an engine driving at least a portion of the process, reduced cooling costs, etc.).

Another liquid:solid handling operation that is performed in many industrial operation (for example, wastewater treatment) is separation of suspended solids from liquids by application of centripetal force. Essentially, centripetal force is applied using a centrifugal separator to impress denser solid components of the suspension against a solid working surface (typically a wall and/or side of a centrifuge vessel or passage). Such operations can be performed continuously or in batches. Typically, a suspension of solids in a liquid is introduced to a drum or vessel that is rotated to provide centripetal force. The denser solids collect along a surface of the drum or vessel and adhere to one another to form a pellet. The liquid phase can then be collected, for example by decanting or pumping. In some applications the solid and liquid phases are directed towards a passage or opening and collected continuously during operation.

In such operations it is common for collected solids to adhere to working surfaces of the centrifugal separator, requiring the device to be taken out of operation for cleaning. In addition, adhesion of the collected solids to working surfaces of the centrifugal separator can impede their movement towards points of solids collection (e.g. the bottom of a centrifuge vessel or the solids collection outlet of a continuous separator). This leads to extended run time and greater energy expenditure. Application of a composition of the inventive concept to the working surfaces of such centrifugal separators provides these surfaces with a low or reduced friction coating that reduces adhesion of separated solids to the working surfaces, resulting in improved efficiency of separation, reduced downtime for maintenance and cleaning, and energy savings due to reduced run times.

It should be appreciated that centrifugal separations of suspended solids are also utilized in processing of various foods, notably separation of whey from curds in dairy processing, processing of soy solids, processing of meat slurries, etc. As noted above compositions of the inventive concept can be prepared from food-grade materials, permitting safe use in food processing equipment. For example, alkylated polyethylene glycol/polypropylene glycol copolymers, which are widely used in cosmetics, have been proposed for use in foods. In addition due to the persistent nature of the low or reduced friction coating so produced, the process used for generation of a low or reduced friction surface in such food handling equipment can incorporate a washing or rinsing step to remove excess coating composition prior to use with foodstuffs.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A method of reducing energy consumption in a solid: liquid handling operation comprising contact between a liquid and a solid working surface, comprising applying a first coating composition to the working surface for a period of time sufficient to generate a persistent reduced friction layer on the working surface, wherein the first coating composition comprises:

a vegetable oil; and a surfactant comprising polyethylene glycol, wherein the surfactant is present at from 3% w/v to 7% w/v relative to the first coating composition, wherein the first coating composition provides a first surface characterized by persistent reduced friction when the first coating composition is applied to a base solid surface, and wherein the first surface shows an 80% or greater reduction in friction relative to a second surface generated by application of a second coating composition comprising the vegetable oil and the surfactant at either less than 3% w/v or greater than 7% w/v relative to the second coating composition to the base solid surface, wherein the second surface is identical to the first surface and the second coating composition and the first coating composition differ only in surfactant content, and wherein friction is determined by retention of solid material on the first and second surfaces; and wherein the solid:liquid handling operation is a centrifugal separation.

2. The method of claim 1, comprising the additional step of rinsing the working surface following the period of time and prior to addition of materials to be mixed.

3. The method of claim 1, wherein the centrifugal separation is at least a portion of a water or waste treatment process.

4. The method of claim 1, wherein the centrifugal separation is at least a portion of a food processing operation.

5. The method of claim 1, wherein the solid:liquid handling operation comprises suspension of a particulate solid within a liquid.

6. The method of claim 5, wherein the solid:liquid handling operation is at least a portion of a construction operation.

7. The method of claim 5, wherein the solid comprises cement or concrete aggregate.

8. A method of generating a persistent low friction solid:liquid interface, comprising applying a first coating composition to the solid for a period of time sufficient to generate the persistent low friction solid:liquid interface, wherein the first coating composition comprises:

a vegetable oil; and a surfactant comprising polyethylene glycol, wherein the surfactant is present at from 3% w/v to 7% w/v relative to the first coating composition, wherein the first coating composition provides a first surface characterized by persistent reduced friction when the first coating composition is applied to a base solid surface, and wherein the first surface shows an 80% or greater reduction in friction relative to a second surface generated by application of a second coating composition comprising the vegetable oil and the surfactant at either less than 3% w/v or greater than 7% w/v relative to the second coating composition to the base solid surface, wherein the second surface is identical to the first surface and the second coating composition and the first coating composition differ only in surfactant content, and wherein friction is determined by retention of solid material on the first and second surfaces; and wherein the solid is a mixing surface utilized in a mixing apparatus.

9. The method of claim 8, comprising the additional step of removing excess first coating composition from the solid prior to use.

10. The method of claim 9, wherein the step of removing comprises rinsing or washing the solid with a fluid that does not include a composition comprising:

a vegetable oil; and a surfactant comprising polyethylene glycol, wherein the surfactant is present at from 3% w/v to 7% w/v.

11. The method of claim 8, wherein the mixing surface is configured to suspend a particulate solid in a liquid.

12. The method of claim 8, wherein the solid is a separating surface utilized in a separation apparatus.

13. The method of claim 12, wherein the separating surface comprises at least a portion of a centrifugal separator.

* * * * *